US006354758B1

(12) United States Patent
Chaulk

(10) Patent No.: US 6,354,758 B1
(45) Date of Patent: Mar. 12, 2002

(54) CONNECTOR ASSEMBLY FOR CONNECTING WALK BOARDS

(76) Inventor: David M. Chaulk, 129 Julio La., Garner, NC (US) 27529

( * ) Notice: Subject to any disclaimer, the term of this patent is extended or adjusted under 35 U.S.C. 154(b) by 0 days.

(21) Appl. No.: 09/497,263

(22) Filed: Feb. 3, 2000

(51) Int. Cl.[7] ..... E04G 1/08

(52) U.S. Cl. ..... 403/102; 403/49; 403/163; 403/167; 182/222

(58) Field of Search ..... 403/102, 49, 194, 403/199, 201, 315, 324, 294, 389, 408.1, 322.2, 397, 252, 255; 182/165, 175, 130, 131, 222, 223

(56) References Cited

U.S. PATENT DOCUMENTS

| | | | | | |
|---|---|---|---|---|---|
| 586,889 | A | * | 7/1897 | Williams | 403/102 |
| 646,347 | A | * | 3/1900 | Betty | 403/102 |
| 1,479,628 | A | * | 1/1924 | Seger | 403/102 |
| 3,877,764 | A | * | 4/1975 | Hillier, Jr. | 403/408.1 |
| 4,499,967 | A | * | 2/1985 | Anderson | 182/222 |
| 4,583,618 | A | * | 4/1986 | Zimmerman | 182/223 |
| 4,624,342 | A | * | 11/1986 | Anderson | 182/223 |
| 4,802,553 | A | * | 2/1989 | Waters et al. | 182/222 |
| 4,825,976 | A | * | 5/1989 | Wyse | 182/222 |
| 5,251,359 | A | * | 10/1993 | Finkl | 403/102 X |
| 5,287,946 | A | * | 2/1994 | Mayo | 182/165 |
| 5,685,660 | A | * | 11/1997 | Liao | 403/102 |

FOREIGN PATENT DOCUMENTS

GB 2028957 * 8/1979

* cited by examiner

*Primary Examiner*—Lynne H. Browne
*Assistant Examiner*—David E. Bochna
(74) *Attorney, Agent, or Firm*—Coats & Bennett, P.L.L.C.

(57) ABSTRACT

A connector assembly that interconnects opposed ends of two walk boards utilized in a scaffolding system. Each connector includes a first plate having a plurality of connector shafts extending therefrom. The connector shafts extend through openings or sleeves formed in the end portions of the respective walk boards. Opposite the first plate is a second plate that includes openings through which the connector shafts extend. Retainers are secured to the respective connector shafts for the purpose of retaining the second plate on the connector shafts while the connector shafts extend through the openings within the walk boards. An interconnecting shaft is extended through a series of openings within the first and second plates of each connector. This interconnecting shaft effectively connects the connectors together and thereby connects the opposed end portions of the walk boards together.

9 Claims, 4 Drawing Sheets

CONNECTOR ASSEMBLY FOR CONNECTING WALK BOARDS

FIELD OF THE INVENTION

The present invention relates to scaffolding systems and to walk boards that form a part of such scaffolding systems and more particularly to a connector assembly for connecting opposed end portions of walk boards together.

BACKGROUND OF THE INVENTION

In the construction industry, scaffolding systems are used for a wide variety of jobs. For example, in residential construction, it is quite common to use scaffolding systems to frame and box around the eaves of structures and to secure siding or wall boards to sides of a framed building.

There are numerous types of scaffolding systems, but one of the most common types of scaffolding systems entails the use of vertical pump jacks that are spaced apart and which act to support opposed ends of walk boards. These walk boards are supported in end-to-end relationship and in doing so, it is customary to find a pump jack disposed at each end of a walk board. Thus, where there are a series of walk boards aligned end-to-end, it is common to find two pump jacks disposed adjacent each other, one pump jack supporting one end of one walk board while the other pump jack supports the end of the other walk board.

It is known to attempt to connect or couple the opposed ends of walk boards together so as to eliminate one pump jack. Essentially, by connecting the opposed ends of walk boards together, a single pump jack can be utilized to support the two walk boards about the coupled area.

Although attempts have been made to connect walk boards, as a general rule the devices that have been utilized are generally very rudimentary structures that are not designed for safety and which do not form a sturdy and reliable interconnecting structure.

Therefore, there has been and continues to be a need for a system and structure for interconnecting opposed ends of walk boards that is safe, reliable and easy to connect and disconnect.

SUMMARY OF THE INVENTION

The present invention entails a method and system for interconnecting opposed ends of walk boards. In particular, the walk board connector assembly of the present invention entails a pair of connectors. One connector connects to the end portion of one walk board while the other connector connects to the end portion of the other walk board. These two connectors are interconnected by a shaft.

In one particular embodiment of the present invention, each connector is made up of a first plate that is adapted to be disposed on one side of the walk board. Secured to the first plate, is a series of connector shafts that extend therefrom. In this particular embodiment, these connector shafts are designed to be inserted through openings or sleeves that are formed in the end portion of the walk board. Once the connector shafts are extended through the openings of the walk board, they project outwardly from the side opposite where the first plate is disposed. A second plate, having openings therein, is inserted over the connector shafts extending from the walk board. Thereafter connector pins or retainers are inserted into the exposed ends of the connector shafts so as to retain the second plate adjacent the side of the walk board opposite the side occupied by the first plate.

In this embodiment, the first and second plates of each connector includes another set of openings that enable an interconnecting shaft to be extended therethrough. This interconnecting shaft effectively couples the first and second connectors together and in the process effectively connects the opposed ends of the walk boards together. Other objects and advantages of the present invention will become apparent and obvious from a study of the following description and the accompanying drawings, which are merely illustrative of such invention.

Other objects and advantages of the present invention will become apparent and obvious from a study of the following description and the accompanying drawings, which are merely illustrative of such invention.

DETAILED DESCRIPTION OF THE INVENTION

Figure 2:
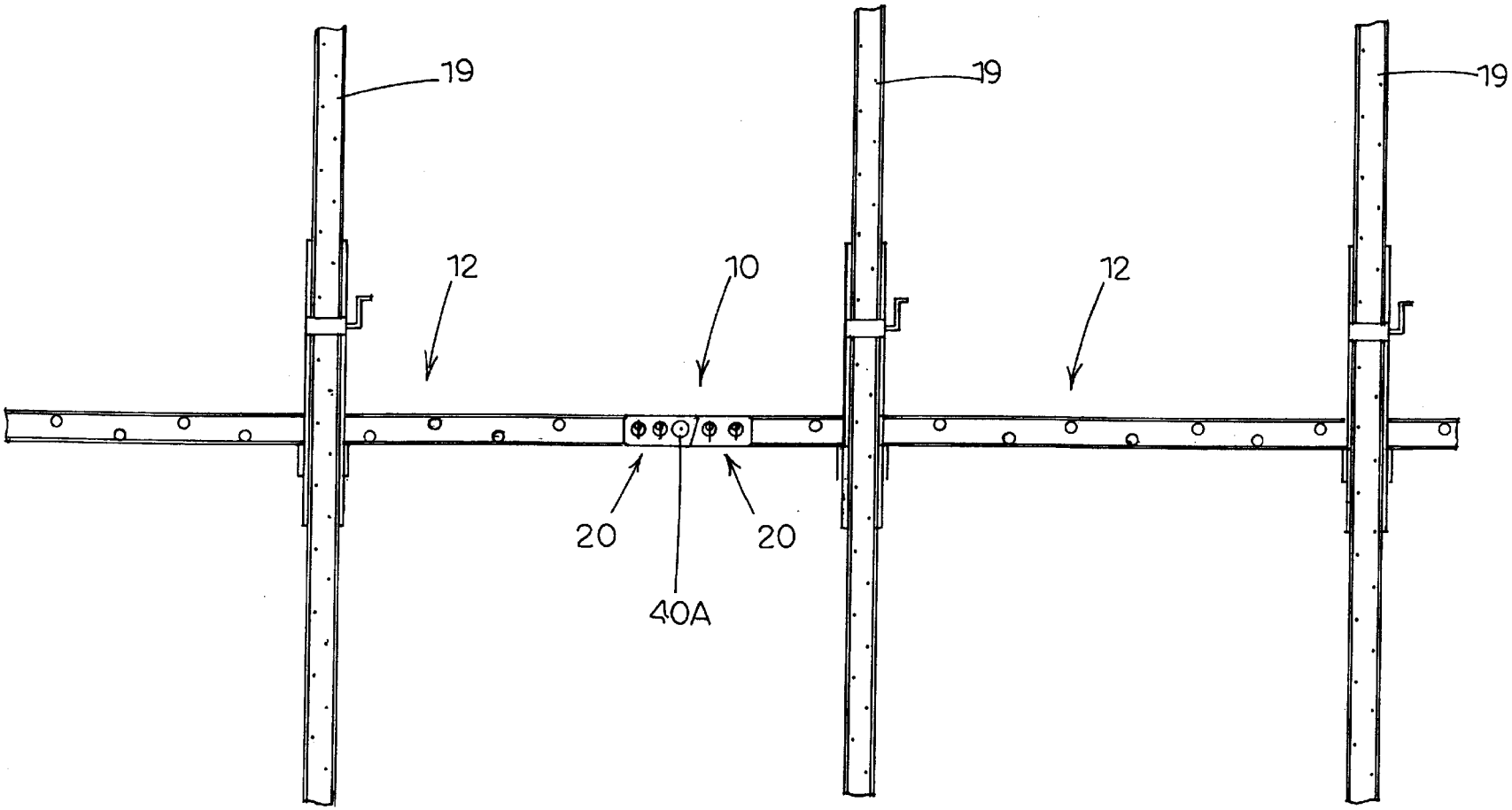
FIG. 2 is a side elevational view showing the connector assembly interconnecting a pair of walk boards that are supported on a series of pump jacks.

With further reference to the drawings, the walk board connector assembly is shown therein and indicated generally by the numeral 10. As will be appreciated from this disclosure, the connector assembly 10 is designed to be used in conjunction with two walk boards, each walk board being indicated generally by the numeral 12 in the drawings. As seen in FIG. 2, the walk boards 12 are supported by a series of vertical pump jacks 19 that form a part of a conventional scaffolding system. Each of the pump jacks includes a support member that extends underneath a respective walk board 12 and supports the same. This support member can be jacked up and down and in doing so the walk board 12 being supported is raised and lowered.

As seen in the drawings, each walk board 12 include a pair of sides 16 and a series of sleeves 14 that extend transversely through the walk boards 12. It should be noted however, that some walk board designs may not include the transversely extending sleeves 14, but still could be interconnected by a connector assembly such as that disclosed herein. In any event, in the case of the walk boards 12 disclosed herein, it is also noted that about the opposed end portions of each walk board 12 there is provided a pair of laterally spaced handles 18. These handles facilitate the handling of the walk boards 12 and further, as will be appreciated in subsequent portions of this disclosure, a portion of the connector assembly 10, in the embodiment illustrated herein, extends through the respective handles 18 of the walk boards 10.

Figure 1:
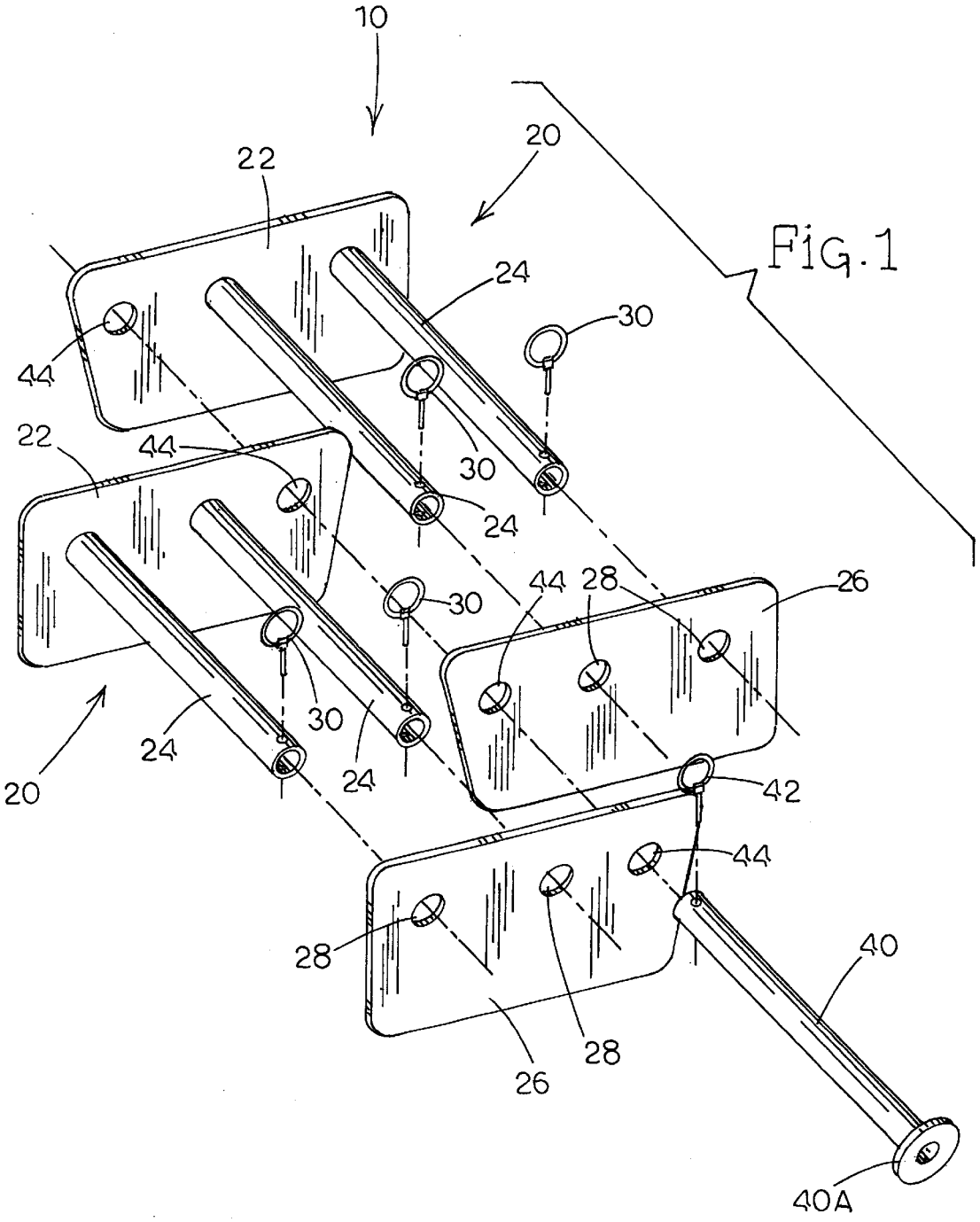
FIG. 1 is a perspective exploded view of the connector assembly of the present invention.
Figure 3:
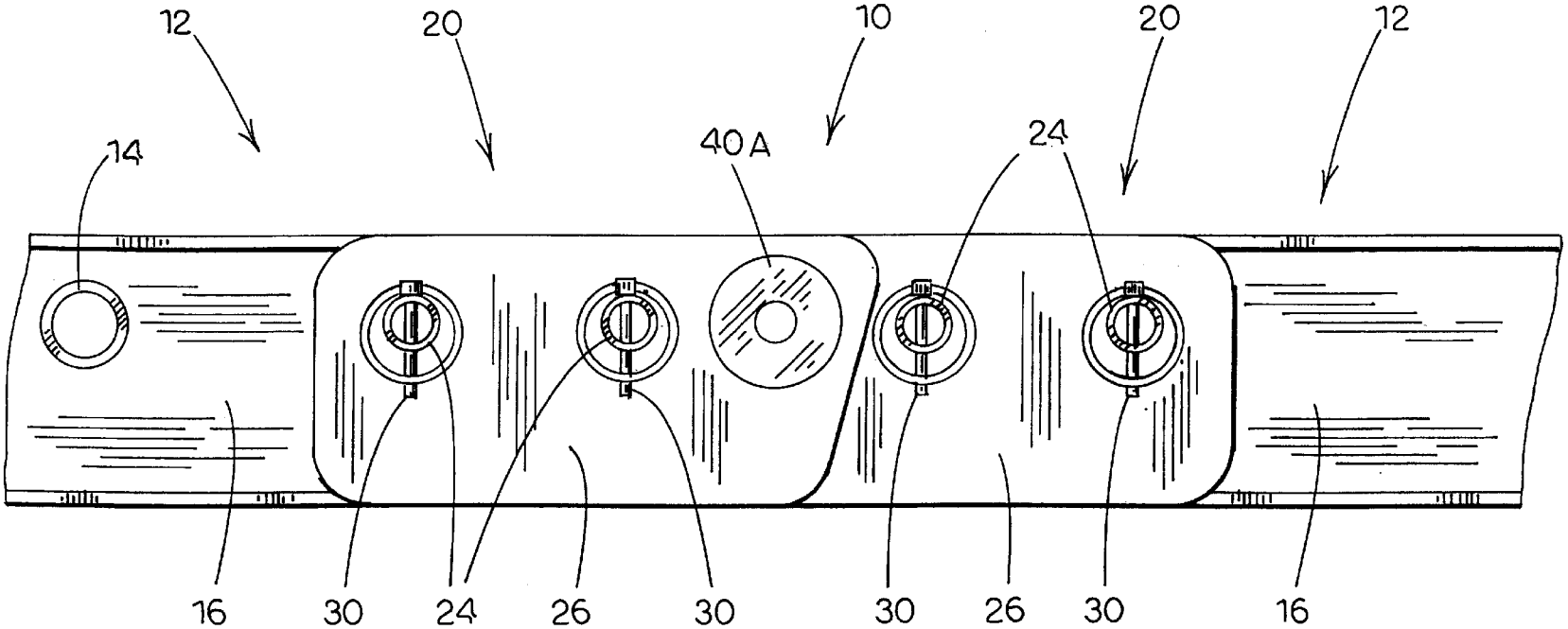
FIG. 3 is a fragmentary side elevational view of two end portions of two walk boards interconnected by the connector assembly of the present invention.
Figure 4:
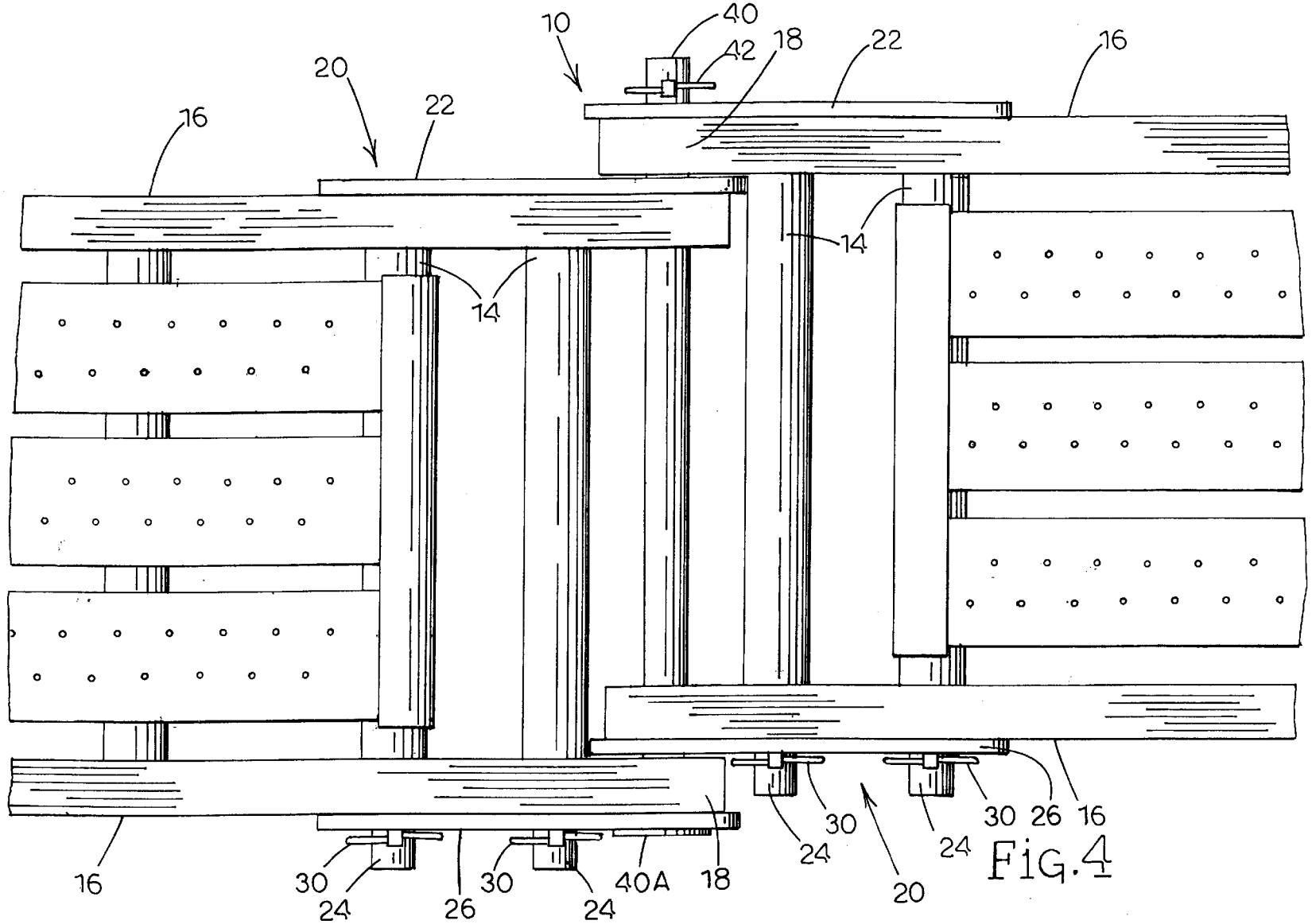
FIG. 4 is a fragmentary top plan view illustrating the connector assembly connecting two walk boards together.

With particular reference to FIGS. 1, 3 and 4, the connector assembly 10 includes two like connectors, each indicated generally by the numeral 20. Each connector includes a first plate 22. Secured to the first plate and extending therefrom and in parallel relationship is a pair of shafts 24. These shafts are sometimes referred to as connector shafts, but it should be understood that the term connector shafts simply means that these shafts 24 serve to engage a portion of respective walk boards 12 for the ultimate purpose of connecting one end portion of one walk board to an end portion of another walk board.

Each connector further includes a second plate 26. Second plate 26 is not permanently fixed to the shafts of 24, but does include two shaft openings 28. As will be appreciated from this disclosure, shaft openings 28 serve to receive the respective shafts 24 when the connectors 20 are interconnected. To retain the second plate on the shafts 24 when the connector assembly assumes a secured mode across adjoining ends of two walk boards 12, there is provided a series of retainers or locking pins 30. These retainers 30 are adapted to extend through openings formed in outboard ends of the shafts 24. As seen in the drawings, when the connector assembly 10 assumes a secured mode, these retainers 30 lie outwardly of the second plate 26 and as such serve to retain or secure the second plate 26 in place and against one side 16 of a respective walk board 12.

Connector assembly 10 includes an interconnecting shaft 40. Interconnecting shaft 40 is designed to extend through portions of the respective connectors 20 and to essentially interconnect or connect the connectors 20 together. Interconnecting shaft 40 includes a collar 40A that serves as a stop. In addition, there is provided another retainer or locking pin 42 that is designed to extend through an opening in one end portion of the shaft 40 for securing the shaft in a locked or secured mode.

Finally, both the first plate 22 and second plate 26 of each connector 20 is provided with an opening 44 for receiving the interconnecting shaft 40. In some instances herein, the interconnecting shaft 40 may be referred to as a pivot shaft. In one embodiment of the present invention, this interconnecting shaft can essentially serve as a pivot shaft inasmuch as once it is connected to both connectors 20 such that the respective end portions of the walk boards 12 can be moved relative to one another.

To connect two walk boards 12 together, a respective connector 20 is secured to an end portion of one walk board. This is accomplished by inserting the two shafts 24 associated with each connector 20 through a pair of sleeves 14 that extend transversely across an end portion of the walk board 12. Since the first plate 22 is secured to the shafts 24 it is seen that once the shafts 24 have been pushed through or extended through the sleeves 14, that the first plate 22 will lie flush against one side 16 of the walk board 12. In this position, out board end portions of the shafts 24 will project outwardly from the sleeves 14 on the other side of the walk board 12. Now the second plate 22 is inserted over the out board ends of the shafts 24. Essentially, the second plate 26 is positioned such that it lies adjacent the side of the walk board opposite the side where the first plate 22 is disposed. Now the retainers or locking pins 30 are extended through the out board end portions of the shafts 24. It is appreciated that the shafts 24 are inserted through the sleeves 14 of the walk board 12 such that the third opening, that is opening 44, lies outwardly of the shafts 24. In the case of the walk board design depicted in the drawings, the third opening or opening 44 is aligned with the handles 18 and particularly the openings formed by the handles 18 when the connectors 20 are disposed in a secured or connected mode.

The second connector 20 is then secured to the end portion of the other walk board 12 in the same manner just described. Once the first and second plates 22 and 24 have been secured to the end portion of the second walk board, then the end portions of the walk boards are placed or positioned in an offset relationship. This is illustrated in FIG. 4. Essentially, the handles 18 of the walk boards are positioned such that the openings of all four handles 18 are generally aligned. Now the interconnecting shaft 40 is extended through the openings 44 formed in the first and second plates 22 and 26. After the interconnecting shaft 40 has been extended through the openings 44, then a retainer 42 is inserted through an end portion thereof opposite the collar 40A. Thus, as seen in the drawings, particularly FIG. 4, the interconnecting shaft 40 connects the first plate 22 of one connector with the first plate 22 of the second connector and at the same time, connects the second plate 26 of one connector with the second plate 26 of the other connector. Because each connector 20 is securely connected to an end portion of a walk board 12, it follows that the interconnecting shaft 40 effectively couples the connectors 20 together and at the same time forms a connection between the adjacent end portions of the two walk boards 12.

In the embodiment illustrated, the interconnecting shaft 40 is not fixed to the first plates 22 or the second plates 26. Thus, these plates can pivot or rotate with respect to the interconnecting shaft. This enables an end portion of one walk board 12 to move upwardly or downwardly relative to the end portion of the other connected walk board.

There are a number of advantages to the walk board connector assembly 10 of the present invention. It is appreciated that once the connector assembly 10 couples two walk boards 12 together, that a single pump jack 19 can be utilized to support the coupled walk boards. That is, a pump jack 19 can be slightly off-set with respect to the interconnecting shaft 40 to where the support associated with the pump jack extends underneath one walk board 12. Because of the coupled relationship that exists, the support associated with the pump jack 19 is effective to support the walk boards 12 in the area where they are coupled together (FIG. 2).

The present invention may, of course, be carried out in other specific ways than those herein set forth without departing from the spirit and the essential characteristics of the invention. The present embodiments are therefore to be construed in all aspects as illustrative and not restrictive and all changes coming within the meaning and equivalency range of the appended claims are intended to be embraced therein.

What is claimed is:

1. An assembly for connecting the end portions of two walk boards that form a part of a scaffolding system comprising:

a. first and second connectors, each connector adapted to be connected to an end portion of a walk board and wherein the connectors themselves are adapted to be interconnected together so as to couple the walk boards together;

b. each connector including:

i. a first plate;

ii. at least one shaft secured to the first plate and extending therefrom;

iii. a second plate having at least one opening formed therein for receiving the shaft;

iv. a retainer for retaining the second plate on the shaft; and c. an interconnecting shaft for securing the first and second connectors together.

2. The assembly of claim 1 wherein the first and second plates of each connector includes an opening for receiving the interconnecting shaft.

3. The assembly of claim 1 wherein each connector is provided with a pair of shafts secured to the first plate, and wherein the second plate of each connector includes a pair of spaced apart openings for receiving the shafts.

4. The assembly of claim 3 wherein the connectors are adapted to be connected in an offset relationship such that portions of the first and second plates of each connector overlap when the connectors are interconnected by the interconnecting shaft.

5. The assembly of claim 1 wherein the retainers are secured to the respective shafts and effectively prevent the second plate from sliding off the shafts.

6. The assembly of claim 5 wherein each retainer comprises a locking pin that extends through a locking pin opening formed in a respective shafts.

7. An assembly for connecting the end portions of two walk boards, comprising:

first and second connectors; each connector connectable to an end portion of one of the walk boards and including a frame structure having a pair of opposed side members and at least one shaft extending between the side members and engaged with a portion of the associated walk board for supporting the same; an interconnecting structure interconnecting the first and second connectors together so as to effectively interconnect the end potions of the two walk boards together; wherein the interconnecting structure includes an interconnecting shaft that extends through a series of openings in the first and second connectors that permits one connector to move with respect to the other connector; wherein the side members of the frame structure comprise first and second plates with the first plate being fixedly secured to the at least one shaft of the frame structure and with the second plate including at least one opening for the shaft to extend therethrough; and wherein in a secured mode the shaft projects from the first plate through the opening in the second plate and wherein there is provided a retainer for retaining the second plate on the shaft.

8. The assembly of claim 7 wherein the frame structure of each connector includes two shafts that are fixedly secured to the first plate and which in a secured mode extend through a pair of openings formed in the second plate.

9. The assembly of claim 8 wherein the end portions of each of the walk boards include transverse openings through which the shafts of the frame structure extend.

* * * * *